US009155955B2

(12) United States Patent
Malamitsas

(10) Patent No.: US 9,155,955 B2
(45) Date of Patent: Oct. 13, 2015

(54) PUTTER STROKE TRAINING DEVICE

(71) Applicant: Benjamin Pierre Malamitsas, Encinitas, CA (US)

(72) Inventor: Benjamin Pierre Malamitsas, Encinitas, CA (US)

( * ) Notice: Subject to any disclaimer, the term of this patent is extended or adjusted under 35 U.S.C. 154(b) by 0 days.

(21) Appl. No.: 14/596,021

(22) Filed: Jan. 13, 2015

(65) Prior Publication Data

US 2015/0238838 A1 Aug. 27, 2015

Related U.S. Application Data

(60) Provisional application No. 61/942,763, filed on Feb. 21, 2014.

(51) Int. Cl.
*A63B 69/36* (2006.01)

(52) U.S. Cl.
CPC ..... *A63B 69/3685* (2013.01)

(58) Field of Classification Search
USPC ..... 473/221, 222, 225, 229, 257, 258, 259, 473/261
See application file for complete search history.

(56) References Cited

U.S. PATENT DOCUMENTS

| | | | | |
|---|---|---|---|---|
| 2,776,836 | A * | 1/1957 | Zadina | 473/226 |
| 3,473,810 | A * | 10/1969 | Nishikawa | 473/229 |
| 4,133,535 | A * | 1/1979 | Marsh | 473/229 |
| 6,551,197 | B1 * | 4/2003 | Travo | 473/258 |
| 7,641,567 | B2 * | 1/2010 | Brooks | 473/257 |
| 8,298,094 | B1 * | 10/2012 | Chen | 473/261 |
| 8,591,349 | B1 * | 11/2013 | Jones | 473/229 |

* cited by examiner

*Primary Examiner* — Nini Legesse
(74) *Attorney, Agent, or Firm* — PatentFile, LLC; Bradley C. Fach; Steven R. Kick

(57) ABSTRACT

A putter stroke training device comprising a putter guide apparatus having a shaft clamp configured to removably secure a golf putter shaft, an arm extension comprising a first end and a second end, wherein the shaft clamp may be coupled to the first end of the arm extension and the arm extension may be configured to extend away from the putter shaft, and wherein a rail contact member may be coupled to the second end of the arm extension; and a putter rail apparatus which may comprise a contact rail with a contact surface configured to make contact with the rail contact member of the putter guide apparatus.

20 Claims, 9 Drawing Sheets

PUTTER STROKE TRAINING DEVICE

CROSS REFERENCE TO RELATED APPLICATIONS

This application claims priority to and the benefit of the filing date of U.S. Provisional Application No. 61/942,763, filed on Feb. 21, 2014, entitled "PUTTING GUIDE APPARATUS AND METHODS", which is hereby incorporated by reference in its entirety.

FIELD OF THE INVENTION

The present invention relates to novel golf enhancing devices and methods for use with golf training activities. More particularly, the invention relates to a putter guide device configured to attach to a wide variety of golf putters to ensure a desired putter orientation throughout a putting stroke.

BACKGROUND

In the game of golf, the winner is determined to be the player that expended the least number of club swings to place the ball in each of eighteen cups of a golf course. As such, it is of paramount important for a golfer to develop a consistent and precise swing, commonly referred to a stroke.

If a consistent stroke is important in the game of golf, then it is often argued that the aspect of putting benefits the most from this consistency. The object of the putting stroke is to strike the ball with the face of the putter club so that the ball travels in the intended line toward the golf cup. Typically, this requires that the face of the putter be precisely perpendicular to the intended path of the ball and that the face of the putter be maintained in this proper perpendicular orientation throughout the putting stroke.

Developing a consistent putting stroke and maintaining the putter face in a perpendicular orientation is one of the most challenging aspects of the game. The human body is comprised of more joints that pivot and rotate during the putting stoke than is convenient to enumerate. Training the various muscles that control these joints to move in a consistent fashion is one recognized way to develop and maintain a consistent putting stroke.

While there are devices and methods that aim to train the golfer to swing the putter in a consistent manner throughout the stroke, they are limited in certain aspects that prevent them from having universal application. Putting guide devices in the prior art are either incompatible with all types and styles of golf putters, or they are unable to accommodate the various body types and postures of golfers. These limitations require golfers and golf trainers to buy multiple training devices in order to find one that is beneficial to a particular golfer. Frequently, a golfer's body composition and posture change over time requiring further training device experimentation.

Therefore, a need exists for a novel putting guide apparatuses and methods that are capable of training the various muscles and joints employed during the putting stroke to move in a consistent fashion. There also exists a need for a putting guide apparatus that can be attached to all of the widely varied types of golf putters available. Finally, there exists a need for a putting guide apparatus that can be used by golfers with infinitely varied body types and postures.

BRIEF SUMMARY OF THE INVENTION

A novel putter stroke training device in provided. In some embodiments, the device may comprise a putter guide apparatus comprising a shaft clamp configured to removably secure a golf putter shaft, an arm extension comprising a first end and a second end, wherein the shaft clamp may be coupled to the first end of the arm extension and the arm extension may be configured to extend away from the putter shaft, and wherein a rail contact member may be coupled to the second end of the arm extension; and a putter rail apparatus which may comprise a contact rail with a generally planar contact surface configured to make contact with the rail contact member of the putter guide apparatus.

In further embodiments, the putter rail apparatus may comprise a contact surface which may be substantially planar and may have a first length (L1) and a first width (W1); the rail contact member of the putter guide apparatus may comprise a second length (L2) and a second width (W2); and the first length (L1) may be greater than the second length (L2) and the first width (W1) may be at least 150% greater than the second width (W2).

In still further embodiments, the putter guide apparatus may comprise a removable putter guide extension which may be removably coupled to the rail contact member.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New golf training apparatuses and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
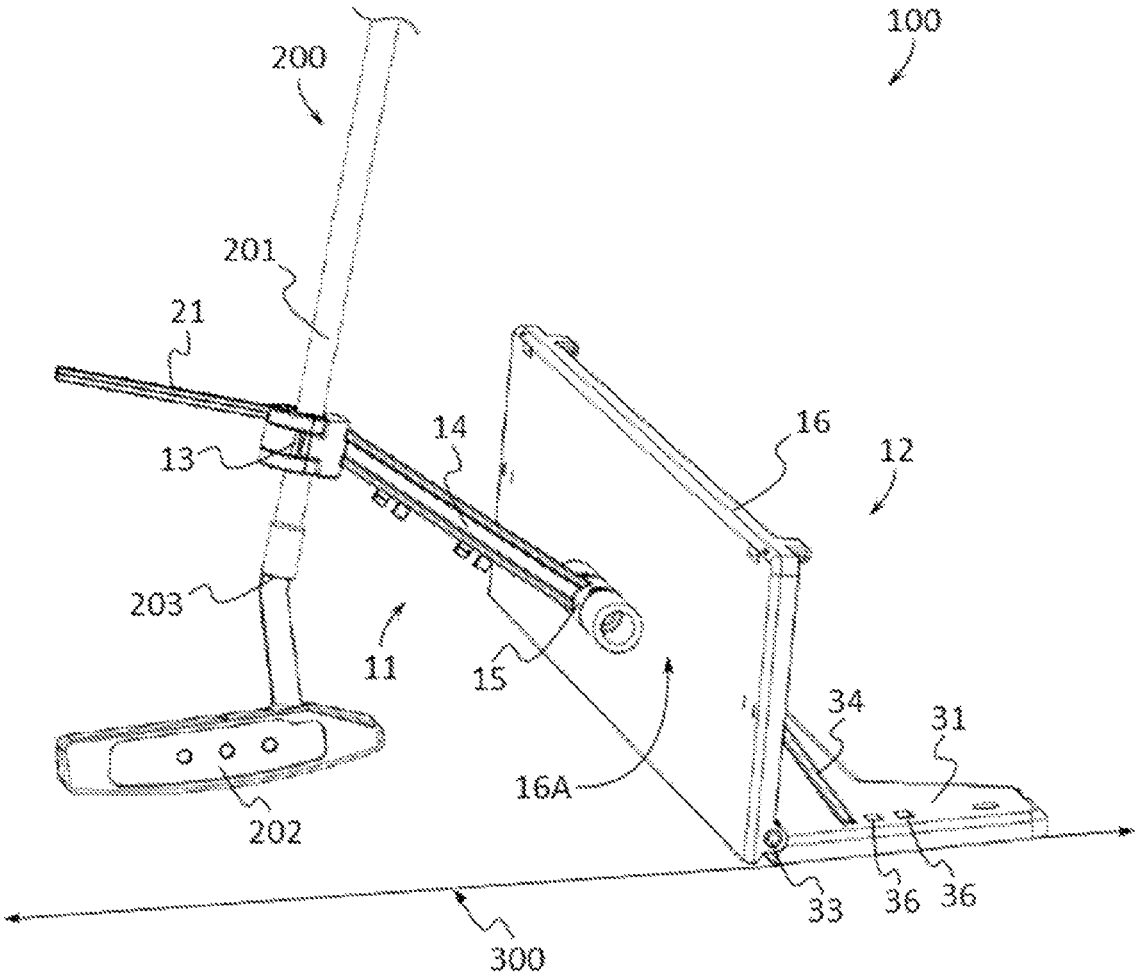
FIG. 1 depicts a perspective view of an example of a putter stroke training device comprising a putter rail apparatus and a putter guide apparatus secured to a putter club according to various embodiments described herein.

The present invention will now be described by referencing the appended figures representing preferred embodiments. FIG. 1 illustrates an example of a putter stroke training device 100 according to various embodiments described herein. In this example, the putter stroke training device 100 comprises a putter guide apparatus 11 and a putter rail apparatus 12. A putter guide apparatus 11 may be configured to removably secure to a golf club such as a putter club 200. In some embodiments, a putter guide apparatus 11 may comprise a shaft clamp 13, an arm extension 14, and a rail contact member 15. An arm extension 14 may comprise a first end 14A and a second end 14B which is configured to extend away from the first end 14A. A shaft clamp 13 may be configured to removably secure a shaft of a putter club 201 and may be coupled to the first end 14A of the arm extension 14. A rail contact member 15 may be configured to contact a portion of the putter rail apparatus 12 and may be coupled to the second end 14B of the arm extension 14 allowing the rail contact member to extend away from the shaft clamp 13.

A putter rail apparatus 12 may comprise a contact rail 16 which may be supported and positioned at an angle relative to a surface such as the ground 300 that the putter rail apparatus 12 is supported by. In some embodiments, the contact rail 16 may comprise a contact surface 16A configured to allow portions of the putter guide to contact and move across or along the contact surface 16A. In further embodiments, the putter rail apparatus 12 may be configured to direct the movement of a putter guide apparatus 11, and a putter club 200 to which the putter guide apparatus 11 is secured to, as portions of the rail contact member 15 contact and move across the guide contacting surface 16A of the contact rail 16.

In some embodiments, a putter stroke training device may comprise: a putter guide apparatus 11 comprising a shaft clamp 13 configured to removably secure a golf putter shaft 201, an arm extension 14 comprising a first end 14A and a second end 14B, to the shaft clamp 13 may be coupled to the first end 14A of the arm extension 14 and may be configured to extend away from the putter shaft 201, and wherein a rail contact member 15 may be coupled to the second end 14B of the arm extension 14; and a putter rail apparatus 12 having a contact rail 16 with a contact surface 16A configured to make contact with the rail contact member 15 of the putter guide apparatus 11.

Figure 2:
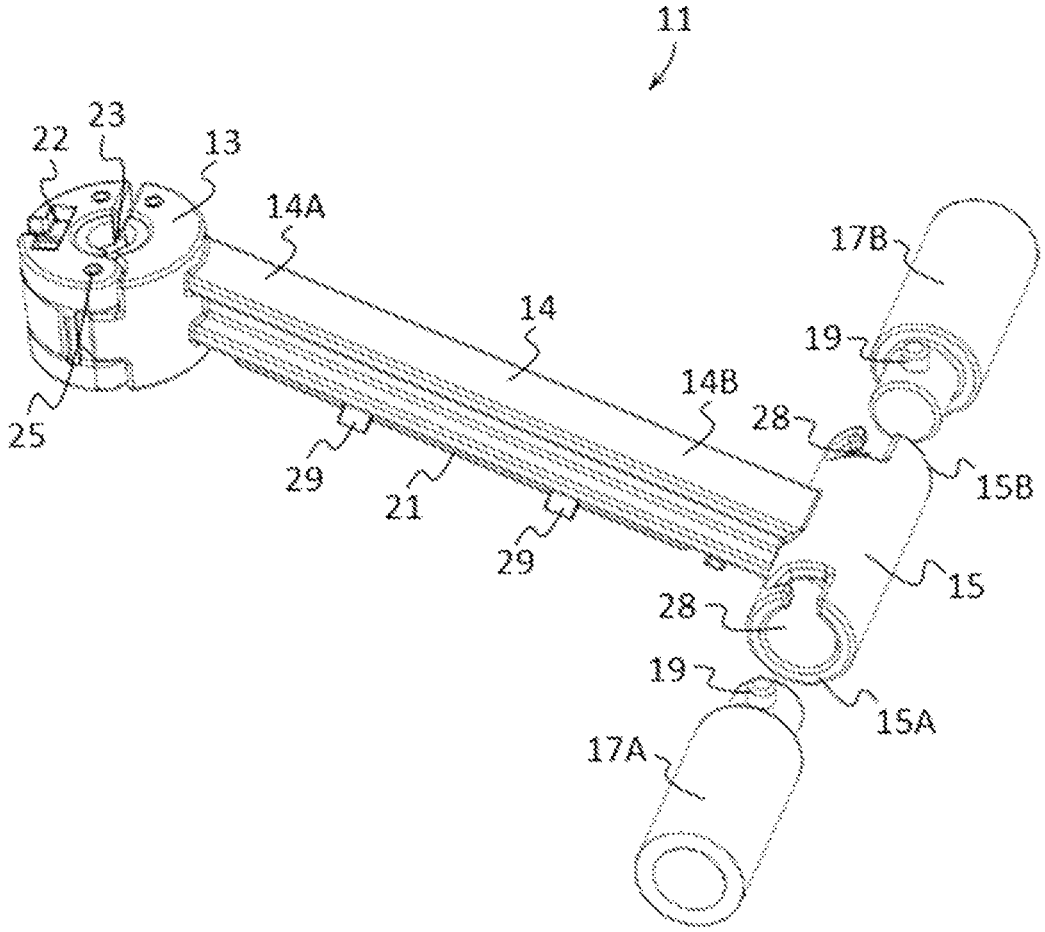
FIG. 2 illustrates a top perspective view of an example of a putter guide apparatus according to various embodiments described herein

FIG. 2 illustrates a side perspective view of an example of a putting guide 11 according to various embodiments of the present invention. In some embodiments, one or more putter guide extensions 17 may be removably coupled to the rail contacting member 15 and configured to further stabilize and guide the angle and distance of the putter club 200 from the putter rail apparatus 12 as the rail contact member 15 contacts and moves across the contact surface 16A of the contact rail 16 (FIG. 1). In preferred embodiments, portions of a rail contact member 15 and/or a putter guide extension 14 may be cylindrical in shape to facilitate movement of the rail contact member 15 and/or putter guide extension 14 across the contact surface 16A of the contact rail 16 as a putter club 200 (FIG. 1) and the putting guide apparatus 11 are swung by a user. In other embodiments, the rail contact member 15 and/or a putter guide extension 17 may be cylindrical in shape, oblong cylindrical in shape, or comprise a combination of substantially cylindrical shapes that facilitate the movement of the rail contact member 15 and/or a putter guide extension 17 across the contact surface 16A of the contact rail 16 as a putter club 200 and the putting guide apparatus 11 are swung by a user.

In some embodiments, the putter guide apparatus 11 may comprise a removable first putter guide extension 17A and/or a second removable putter guide extension 17B which may be each be temporarily coupled to a distal end of a rail contact member 15 such as a first distal end of a contact member 15A and a second distal end of a contact member 15B, respectively. The rail contact member 15 may comprise a generally cylindrical shape which may be configured to contact and move across or along the contact surface 16A (FIG. 1). In further embodiments, a removable putter guide extension 17 may be removably coupled to the rail contact member 15 of the putter guide apparatus 11 with a fastener 19. In some preferred embodiments, the fastener 19 may comprise a cam lock fastening method, in which the fastener 19 of a putter guide extension 17 may be inserted and rotated into a cam lock aperture 28 on a rail contact member 15 thereby frictionally and mechanically removably coupling a putter guide extension 17 to a rail contact member 15.

In other embodiments, a putter guide extension 17 may be removably coupled to a rail contact member 15 by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function.

In some embodiments, the putter guide apparatus 11 may comprise a first putter guide extension 17A and a second putter guide extension 17B which may each be temporarily coupled to a contact member 15. A first putter guide extension 17A and a second putter guide extension 17B may each also comprise a generally cylindrical shape and may be temporarily coupled to a first distal end of a contact member 15A and a second distal end of a contact member 15B, respectively. When a first putter guide extension 17A and a second putter guide extension 17B are coupled to the contact member 15, as the contact member 15 is contacting and moving across or along the contact surface 16A (FIG. 1), the first putter guide extension 17A and a second putter guide extension 17B may then also simultaneously contact and move across or along the guide contact surface 16A. In this manner, the amount of surface area of a putter guide apparatus 11 that is configured to contact the contact rail 16 may be adjusted. Without either a first putter guide extension 17 or a second putter guide extension 17 coupled to the contact member 15, the amount of surface area a putter guide apparatus 11 that is configured to contact the contact rail 16 may be limited to the surface area provided by the contact member 15. Coupling one of a first putter guide extension 17 or a second putter guide extension 17 to the contact member 15 may allow both the contact member 15 and a coupled putter guide extension 17 to provide surface area configured to contact the contact rail 16 that is greater than the surface area provided by the contact member 15 alone. Likewise, by coupling a first putter guide extension 17 and a second putter guide extension 17 to a first end of a contact member 15A and a second end of a contact member 15B, respectively, a contact member 15 and the first coupled putter guide extension 17 and second coupled putter guide extension 17 may provide surface area configured to contact the contact rail 16 that is greater than the surface area provided by the contact member 15 and one putter guide extension 17.

In some embodiments, where less stability is desired, one or more putter guide extensions 17 may be removed from the rail contact member 15 to provide less stability and guidance with respect to the angle and distance of the putter club 200 (FIG. 1) from the putter rail apparatus 12 (FIG. 1) for golfers including advanced golfers. In other embodiments, where more stability is desired, one or more putter guide extensions 17 may be removably coupled to the rail contact member 15 to provide greater stability and guidance with respect to the angle and distance of the putter club 200 from the putter rail apparatus 12 for golfers including moderately skilled golfers. In further embodiments, where even more stability is desired, one or more putter guide extensions 17 may be removably coupled to one or more putter guide extensions 17 that are already removably coupled to the rail contact member 15 to provide even greater stability and guidance with respect to the angle and distance of the putter club 200 from the putter rail apparatus 12 for golfers including novice golfers.

In other embodiments, one or more putter guide extensions 17 may be configured to temporarily attach to the putter guide apparatus 11 and further attach to other putter guide extensions 17 to provide combinations of putter guide extensions 17 with various lengths. In further embodiments, the putter guide extensions 17 may be temporarily attached to the putter guide apparatus 11 with a threaded screw type connection method, a push-to-lock type connection method, a turn-to-lock type connection method, or any other suitable temporary connection method as one reasonably skilled in the art could envision to serve the same function. In still further embodiments, one or more putter guide extensions 17 may be permanently attached to or integrally formed to the putter guide apparatus 11.

Figure 3:
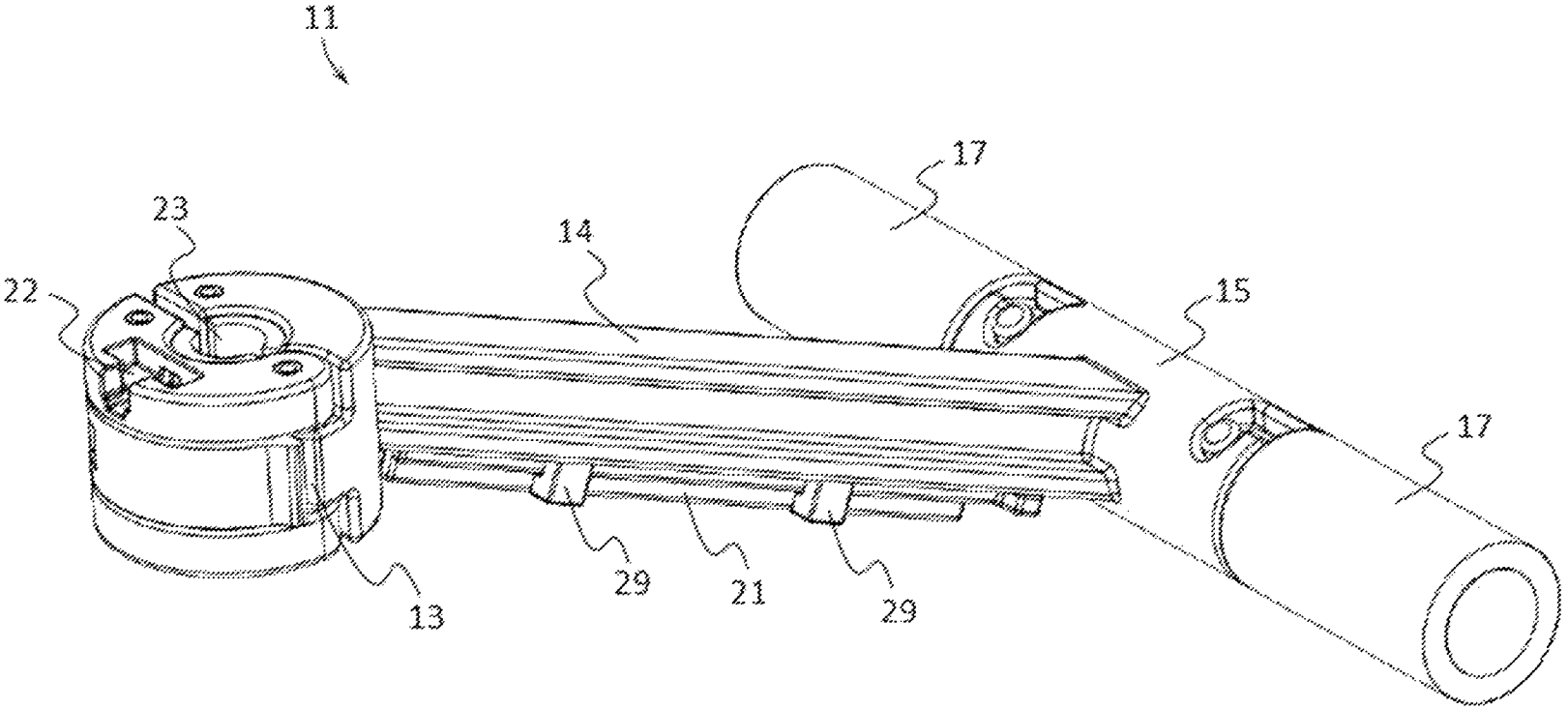
FIG. 3 shows a side perspective view of an example of a putter guide apparatus according to various embodiments described herein.
Figure 4:
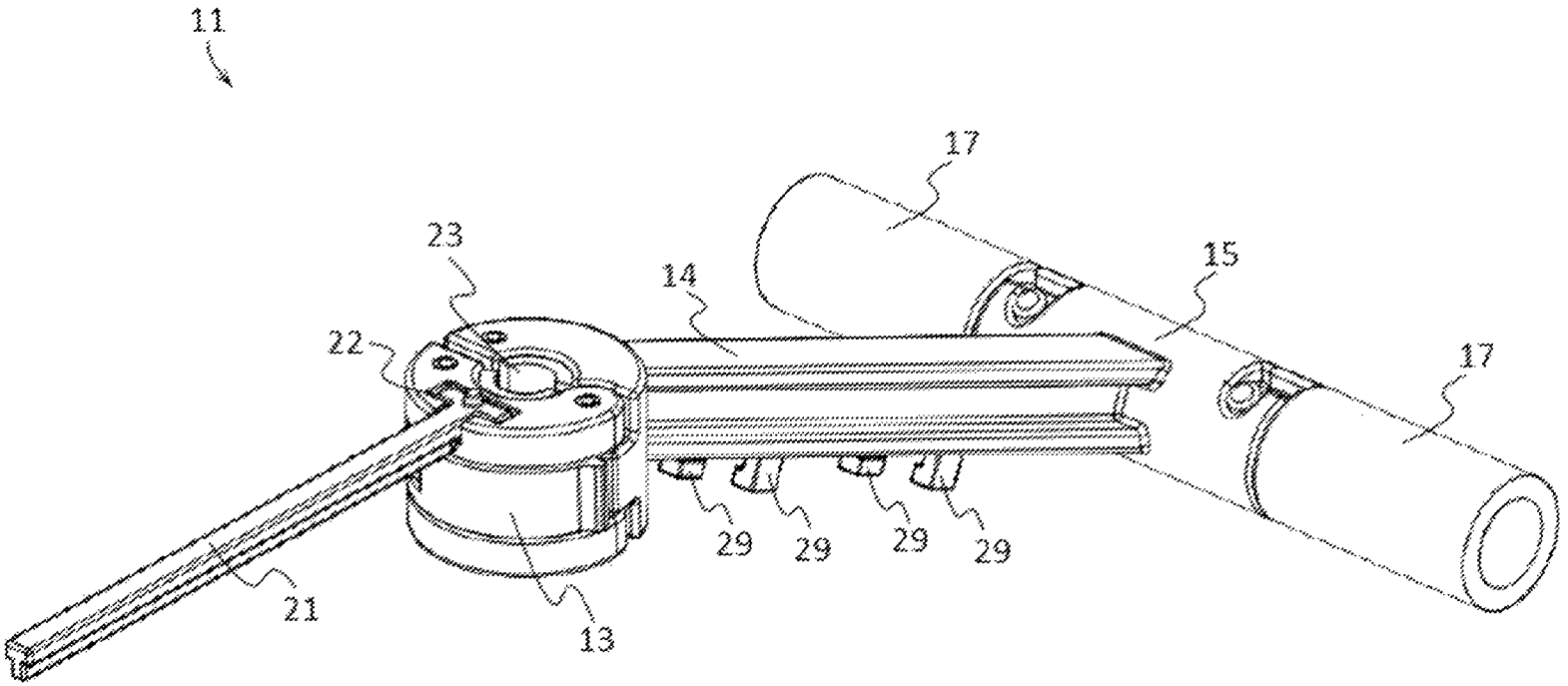
FIG. 4 depicts a side perspective view of an example of a putter guide apparatus according to various embodiments described herein.

Turning now to FIG. 3 and FIG. 4 which depict a side perspective view of an example of a putter guide apparatus 11 according to various embodiments described herein is shown. In some embodiments, the putter guide apparatus 11 may comprise an alignment aid 21 which may be temporarily coupled to one or more locations on the putter guide apparatus 11 such as to the shaft clamp 13 (FIGS. 1 and 4) and/or to the arm extension 14 (FIGS. 2 and 3). An alignment aid 21 may be removably coupled to the shaft clamp 13 and configured to extend away from the arm extension to provide a method for maintaining the orientation of the putter face 202 of the putter club 200 (FIG. 1) relative to the user during the swing as the putter guide apparatus 11 contacts and moves across the putter rail apparatus 12 (FIGS. 1 and 6). The user may removably couple the alignment aid 21 to the shaft clamp 13 by inserting or frictionally securing a portion of the alignment aid 21 into an alignment aid recess 22 (FIGS. 2-5) although any other method of temporarily coupling the alignment aid 21 to the shaft clamp 13 may be used. As the user grips a putter club 200 (FIG. 1) that is removably secured to the putter guide apparatus 11, the eyes of the user may be positioned over the putter club 200 and the alignment aid 21 may be positioned so that it is parallel to the putter face 202 as viewed by the user. Optionally, the user may position the device 100 so that any portion of the putter club 200 may be parallel with the alignment aid 21 as viewed by the user. As the user moves the putter club 200, this method may be used to visualize how much wrist break the user has through impact of the putter club 200 with a golf ball. For example, the alignment aid 21 may be positioned to appear one quarter of an inch in front of and parallel to the putter face 202 as viewed by the user. As the putt is stroked, the positioning of the alignment aid 21 relative to the putter club 200 may be maintained. If when viewed by the user, the positioning of the alignment aid 21 relative to the putter club 200 appears to change, that may indicated that the user is breaking their wrists during the putt. In further embodiments, when the alignment aid 21 is not in use it may be to the arm extension 14 (FIGS. 2 and 3) by inserting and frictionally securing the alignment 21 between two or more clip arms 29 although any other method of temporarily coupling the alignment aid 21 to the putter guide apparatus 11 may be used.

Figure 5:
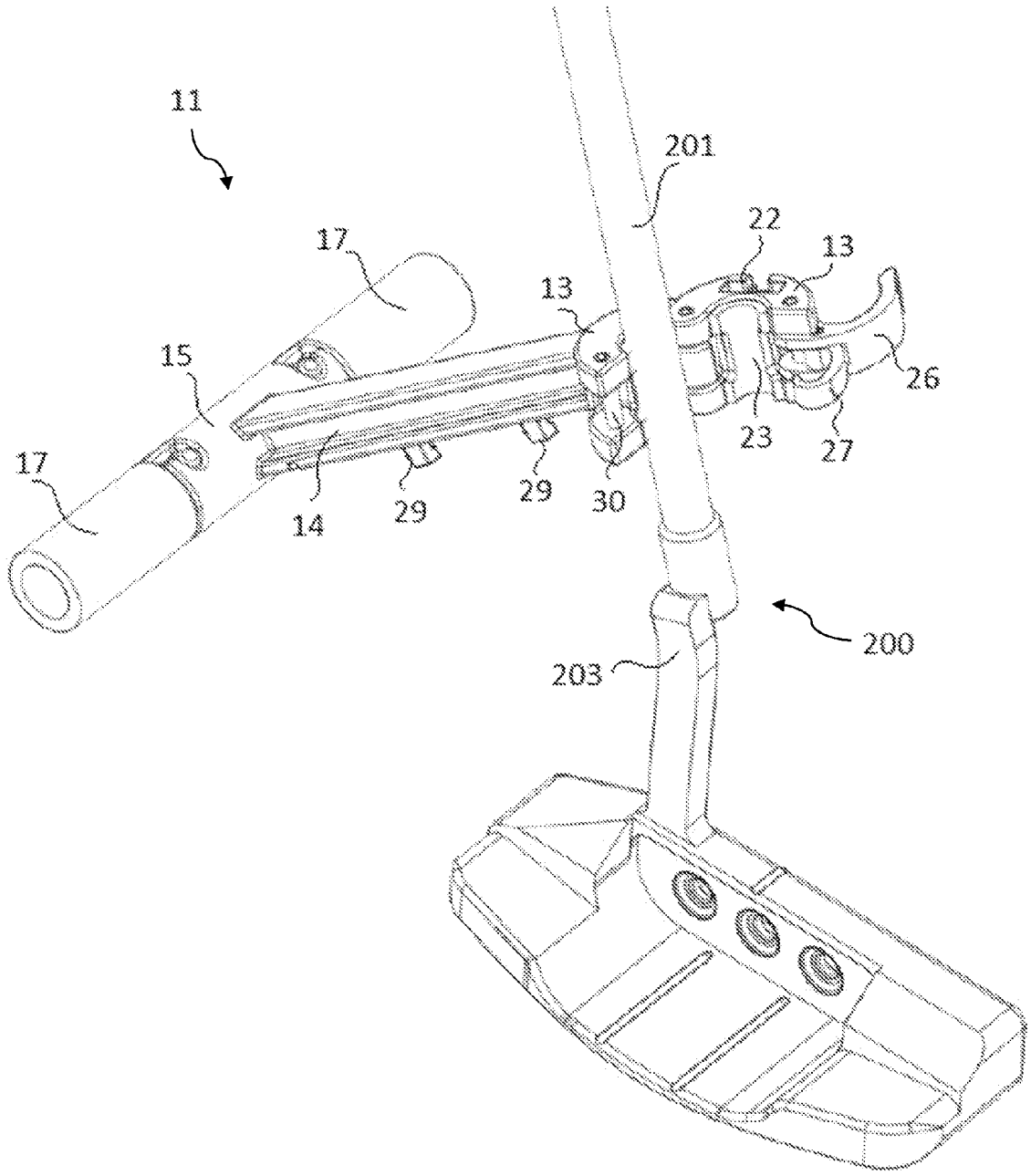
FIG. 5 illustrates a side perspective view of an example of a putter guide apparatus and putter club according to various embodiments described herein.
Figure 6:
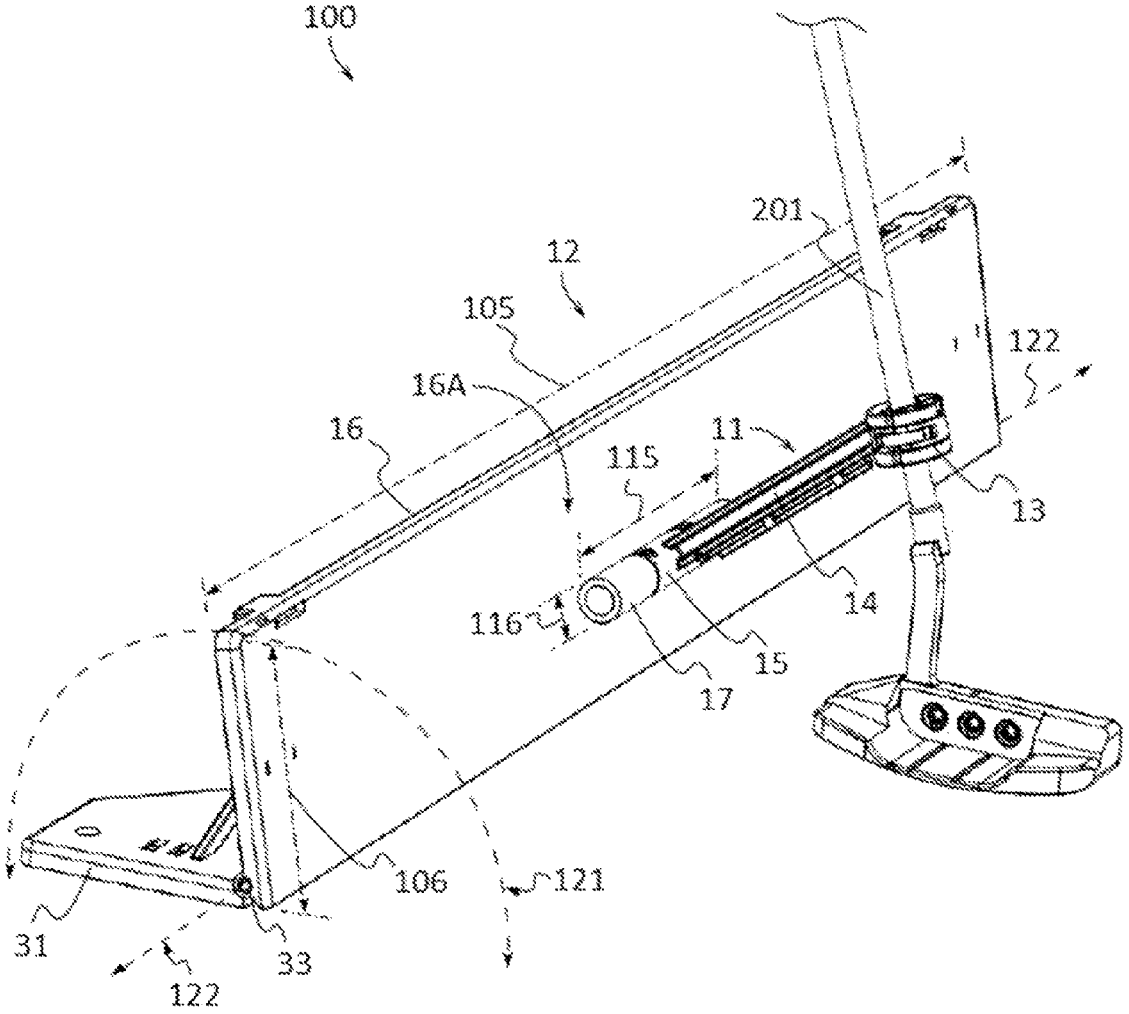
FIG. 6 shows a perspective view of an example of a putter stroke training device and a putter guide apparatus comprising a putter guide apparatus secured to a putter club according to various embodiments described herein.

Referring now to FIG. 5, a side perspective view of an example of a putter guide apparatus 11 comprising a shaft clamp 13 and a putter club 200 according to various embodiments described herein. A shaft clamp 13 may comprise a shaft aperture 23 which may be configured to receive the shaft of a putter club 201 generally above the hosel 203 of the putter club 200. In this embodiment, the shaft clamp 13 may comprise a clamp hinge 25 which may allow portions of the shaft clamp 13 to temporarily separate to allow the shaft of a putter club 201 to be secured and released from the shaft clamp 13. A shaft clamp 13 may further comprise a shaft clamp latch 27 which may be actuated by a shaft clamp handle 26. Portions of the shaft clamp latch 27 may be secured and released from portions of the shaft clamp 13 such as to a shaft clamp catch 30, thereby securing and releasing the shaft of a putter club 201 in the shaft aperture 23 by securing and releasing the shaft clamp handle 26.

In alternative embodiments, a shaft clamp 13 may comprise two fastener apertures which are configured to accept and secure one or more threaded fasteners such as a bolt and wing nut. In some embodiments, the shaft clamp 13 may comprise one, three, or more fastener apertures. The putter guide apparatus 11 may be secured to a putter club 200 by inserting the shaft 201 of the golf putter into the shaft clamp 13 and then tightening one or more threaded fasteners, such as a bolt type fastener and wing nut type fastener. In further embodiments, the threaded fasteners may be tightened and loosened by hand, while other embodiments may use fasteners that may require the use of tools to tighten and loosen them. In other embodiments, one or more screw type, nut type, lever locking, or any other type of fastener of fastening method configured to removably secure a may be used to removably secure a golf putter shaft 201 to the putter guide apparatus 11 may be used.

In some embodiments, a compressionable material 24 may be configured to line the portions of the shaft aperture 23 which are configured to contact portions of a putter club 200 such as the shaft of the putter club 201. In further embodiments, the shaft clamp 13 of the putter guide apparatus 11 may comprise a compressionable material 24 configured to make contact with and frictionally secure the shaft of a putter 201 above the putter hosel 203. The compressionable material 24 may prevent the shaft clamp from damaging the putter club 200 and/or prevent the putter club 200 from being moved or removed from the shaft clamp 13 until the user releases the shaft of the putter club 201 from the shaft clamp 13 such as by releasing a shaft clamp latch 27 or other fastener. In further embodiments, a compressionable material 24 may comprise silicone rubber, ARTiLAGE foams, Poron foams, silicone foams, rubber foams, plastic foams, neoprene foam, latex foam rubber, polyurenthane foam rubber, or elastomer materials such as elastic plastics, elastic silicone, elastic rubbers, silicone rubbers, or any other suitable elastomer or resilient material.

FIG. 6 shows a perspective view of an example of a putter stroke training device 100 comprising a putter rail apparatus 12 and a putter guide apparatus 11 secured to a putter club 200 according to various embodiments described herein. In this illustration it can be seen that the putter stroke training device 100 is configured to provide a method for improving the putter stroke of a golfer to guide the movement of a putter club 200 by maintaining the angle and distance of the putter club 200 in relation to the putter rail apparatus 12. In some embodiments, a putter guide apparatus 11 may comprise a shaft clamp 13 configured to removably secure a golf putter shaft 201 above the hosel 203; an arm extension 14 coupled to the shaft clamp 13 at a first end 14A and extending away from the putter shaft 201 at an angled orientation; and a rail contact member 15 coupled to the second end 14B of the arm extension 14. In some embodiments, the arm extension 14 may comprise an angled orientation with the arm extension angled away from the shaft clamp 13 between 10 and 180 degrees.

The shaft clamp 13 may be attached to the shaft 201 of the putter club 200 and therefore maintains the spatial relationship and orientation between the putter club 200, arm extension 14, and the contact member 15. The rail contact member 15 and/or one or more putter guide extensions 17 may be configured to contact and slide along the contact surface 16A of the contact rail 16 thereby guiding the angle and distance of the putter club 200 from the putter rail apparatus 12. In preferred embodiments, the rail contact member 15 and/or one or more putter guide extensions 17 may be cylindrical in shape to facilitate movement of the rail contact member 15 and/or one or more putter guide extensions 17 across the contact surface 16A of the contact rail 16 as a golf putter 200 and the putter guide apparatus 11 are swung by a user. In other embodiments, a putter guide 13 and/or one or more putter guide extensions 17 may be cylindrical in shape, oblong cylindrical in shape, or comprise a combination of substantially cylindrical shapes that facilitate the movement of the putter guide 13 across the rail 211 as a golf putter and the putting device apparatus 100 are swung by a user.

In preferred embodiments, the contact surface 16A of the contact rail may comprise a generally or substantially planar shape which is configured to facilitate the contact and movement of the rail contact member 15 and/or one or more putter guide extensions 17 across the contact surface 16A of the contact rail 16. In further embodiments, the contact surface 16A of the putter rail apparatus 12 may be substantially planar and have a first length (L1) 105 and a first width (W1) 106 which may define a generally rectangular shape. Also, the rail contact member 15 of the putter guide apparatus 11 may have a second length (L2) 115 and a second width (W2) 116 with said rail contact member 15 (and optionally extensions 17) having a substantially cylindrical shape. In these embodiments, the first length (L1) 105 may be greater than the second length (L2) 115 and the first width (W1) 106 may be at least 50% greater but preferably at least 100% greater, and even more preferably at least 150% greater than the second width (W2) 116 so that the dimensions of the contact surface 16A of the contact rail 16 may be substantially larger than the dimensions of the rail contact member 15.

Figure 7:
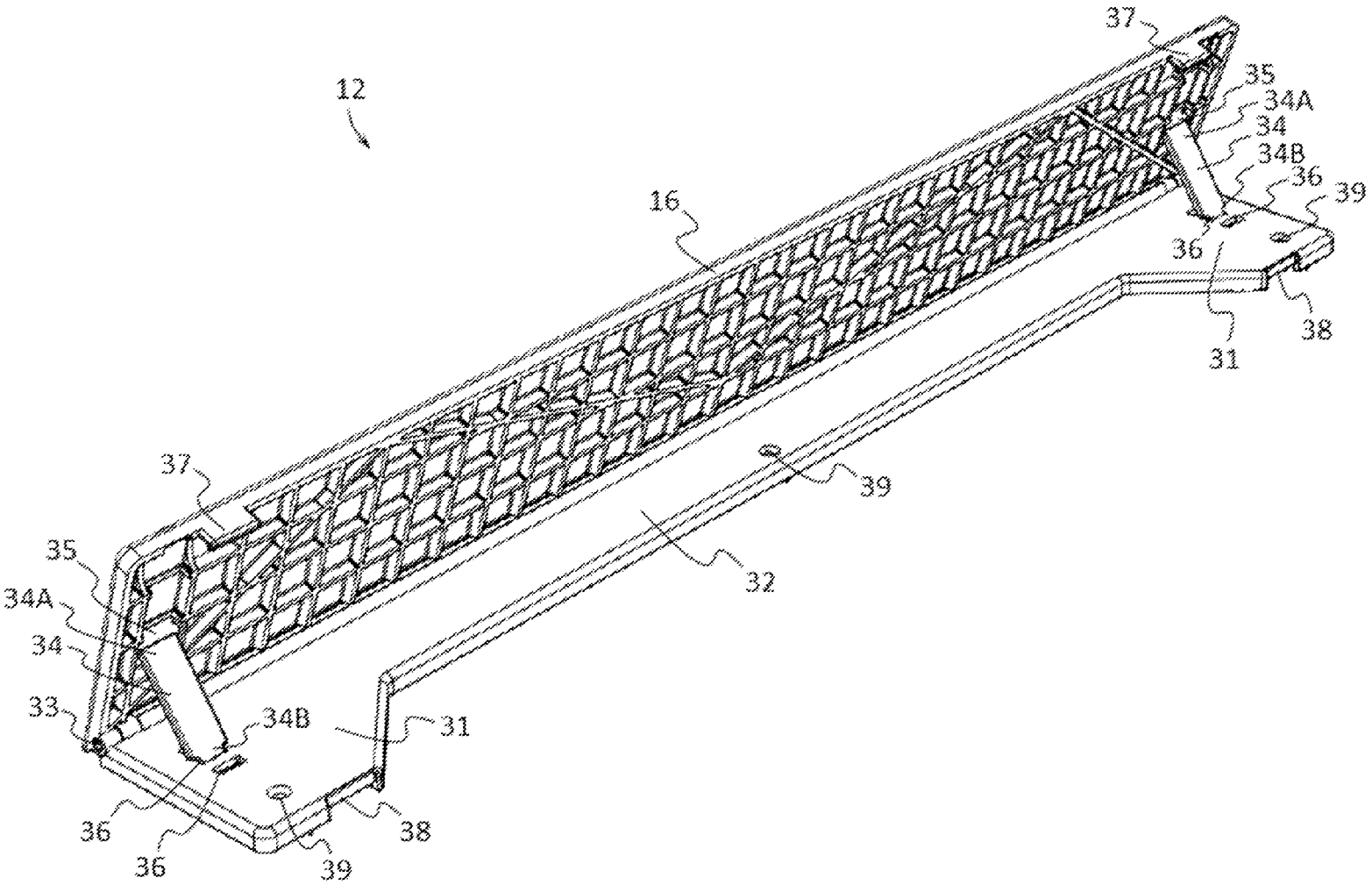
FIG. 7 depicts a rear perspective view of an example of a putter rail apparatus according to various embodiments described herein.

FIG. 7 depicts a rear perspective view of an example of a putter rail apparatus 12 comprises a contact rail 16 which is flexibly coupled with a support leg 31 and which may be secured into one of a plurality of angled positions relative to the ground 300 according to various embodiments described herein. Flexibly coupled may refer to a bendable attachment of a contact rail 16 to a support leg 31, such as can be achieved by a hinge. A hinge may encompass any type of hinge known in the art, including so-called "living" hinges, which typically comprise a linear, relatively flexible area between two relatively more rigid components, such as a line of thin plastic between thicker plastic portions, as is well known in the art. In some embodiments, a rail hinge 33 may provide a flexible coupling or hinge between a contact rail 16 and a support leg 31 and may comprise a piano hinge which may be formed with one or more portions of a contact rail 16 which are configured to interlock with one or more portions of a support leg 31 thereby forming a flexible coupling which connects a contact rail 16 to a support leg 31 that is configured to allow an angle of rotation 121, about the axis 122 provided by the rail hinge 33, between the contact rail 16 and a support leg 31. By changing the angle of rotation 121, the contact rail 16 may be positioned in a plurality of angled positions relative to the ground 300 that the support leg 31 is contacting.

By flexibly coupling a support leg 31 to the contact rail 16, the device 100 may be adjusted for golfers that stand closer to the ball and prefer to swing the putter club 200 in a line of travel closer to vertical, by changing the angle of the contact rail 16 relative to the ground and/or a support leg 31 may be decreased. Conversely, for golfers that stand further from the ball and prefer to swing the putter club 200 in a line of travel further from vertical, the angle of the contact rail 16 from vertical may be increased by changing the angle of the contact rail 16 relative to the ground and/or a support leg 31.

In other embodiments, a rail hinge 33 may comprise a butt hinge, barrel hinge, butt/Mortise hinge, case hinge, flag hinge, strap hinge, H hinge, HL hinge, piano hinge, butterfly hinge, flush hinge, barrel hinge, concealed hinge, continuous hinge, T-hinge, strap hinge, double-acting hinge, Soss hinge, counterflap hinge, flush hinge, coach hinge, rising butt hinge, double action spring hinge, tee hinge, friction hinge, security hinge, cranked hinge or storm proof hinge, lift-off hinge, self closing or self positioning hinge, flexible material hinge, or any other type or style of hinge suitable for flexibly coupling a contact rail 16 to a support leg 31.

In this example, the putter rail apparatus 12 comprises a contact rail 16, two adjustable support brace members 34, a rail hinge 33, six brace notches 36, and two support legs 31. A support brace member 34 may comprise a first end 34A and a second end 34B. The contact rail 16 of the putter rail apparatus 12 may be secured into one of a plurality of angled positions by a support brace member 34 having a first end 34A rotatably coupled to the contact rail 16 and a second end 34B configured to temporarily mate with a brace notch 36 located on a support leg 31. A first end 34A may be rotatably coupled to or flexibly coupled to the contact rail 16 with a support brace member hinge 35 comprising any type of flexible coupling such as any type of hinge. The second end 34B of the support brace member 34 may be configured to temporarily mate or insert into one or more brace notches 36 located on a support leg 31. By positioning and mating the second end 34B of a support brace member 34 into a brace notch 36 on a support leg 31 located closer to the rail hinge 33, the angle of the contact rail 16 from relative to the ground 300 or the support leg 31 (angle of rotation 121) may be decreased. Conversely, by positioning and mating the second end 34B of a support brace member 34 into a brace notch 36 on a support leg 31 located further from the rail hinge 33, the angle of the contact rail 16 relative to the ground 300 or the support leg 31 (angle of rotation 121) may be increased.

In other embodiments, the contact rail 16 of the putter rail apparatus 12 may be secured into one of a plurality of angled positions relative to the ground by a support brace member 34 having a first end 34A configured to temporarily mate with a brace notch 36 located on the contact rail 16 and a second end 34B rotateably coupled to a support leg 31. By positioning and mating the first end 34A of a support brace member 34 into a brace notch 36 on the contact rail 16 located closer to the rail hinge 33, the angle of the contact rail 16 from relative to the ground 300 or the support leg 31 (angle of rotation 121) may be decreased. Conversely, by positioning and mating the first end 34A of a support brace member 34 into a brace notch 36 on the contact rail 16 located farther from the rail hinge 33, the angle of the contact rail 16 relative to the ground 300 or the support leg 31 (angle of rotation 121) may be increased. In still further embodiments, the contact rail 16 may be flexibly coupled to a support leg 31 with another adjustable method allowing the angle of the contact rail 16 relative to the ground 300 or the support leg 31 (angle of rotation 121) to be increased or decreased.

Figure 8:
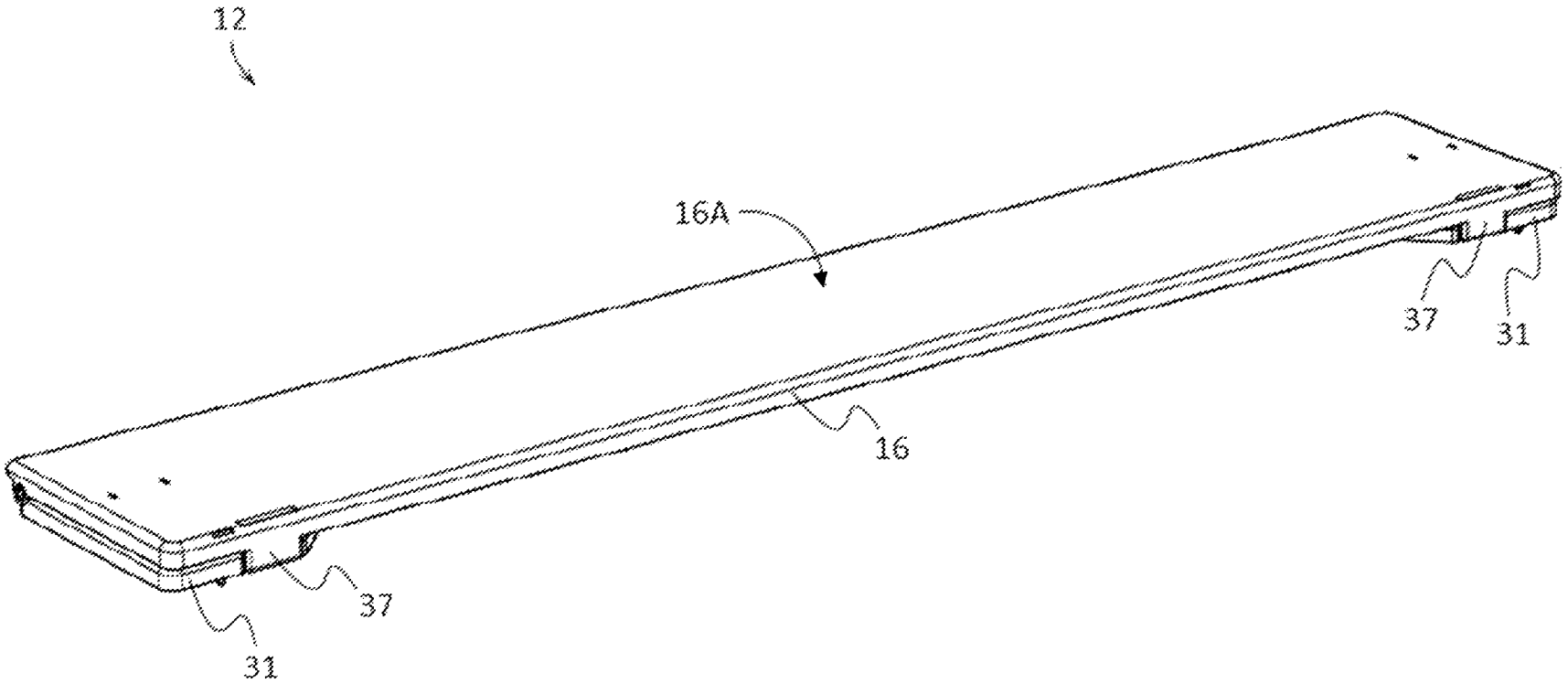
FIG. 8 illustrates a top perspective view of an example of a putter rail apparatus according to various embodiments described herein.
Figure 9:
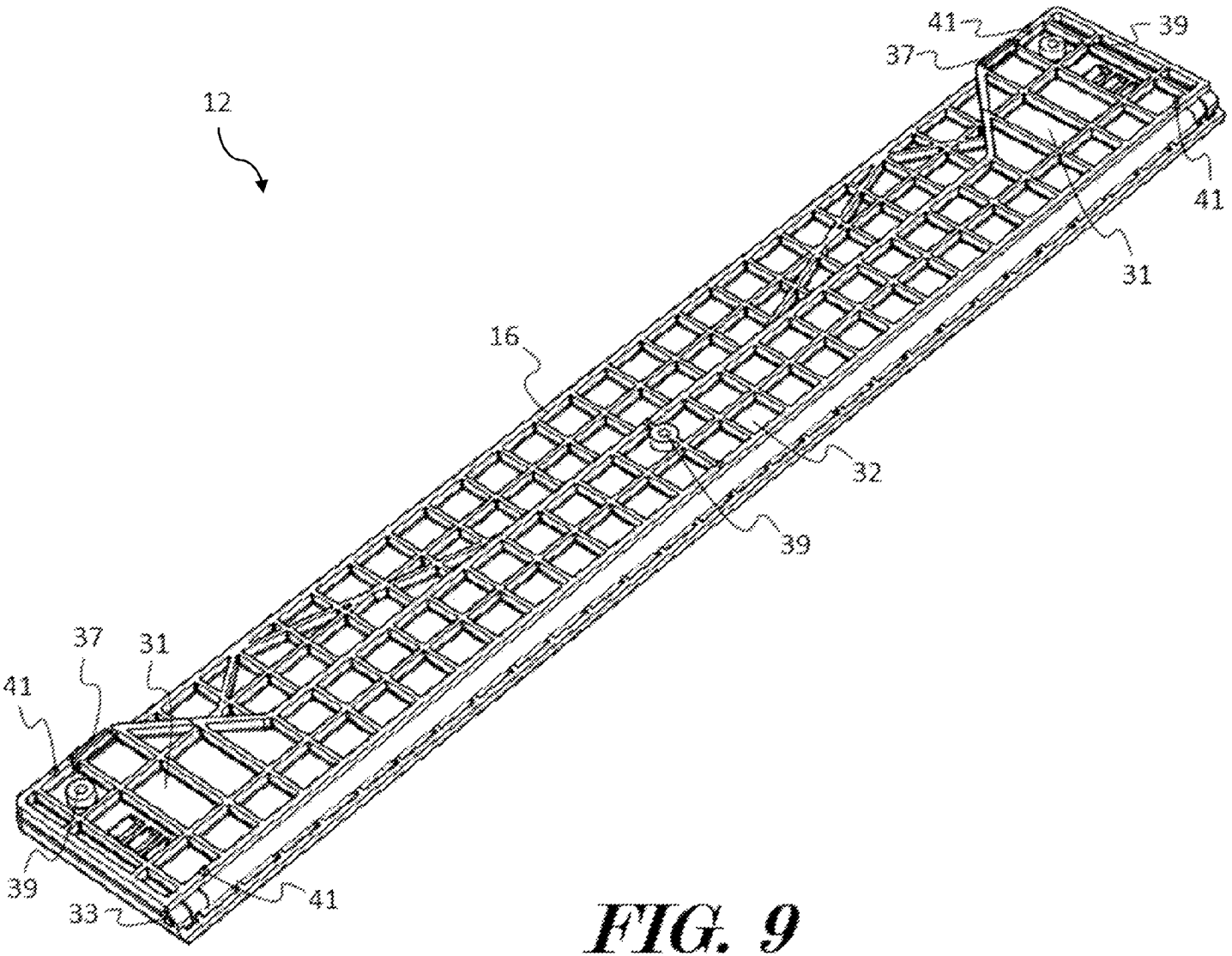
FIG. 9 shows a bottom perspective view of an example of a putter rail apparatus according to various embodiments described herein.

As perhaps best illustrated by FIG. 8 which shows a top perspective view of an example of a putter rail apparatus 12 and FIG. 9 which shows a bottom perspective view of an example of a putter rail apparatus 12 according to various embodiments described herein, the contact rail 16 may be secured into one of a plurality of angled positions relative to the ground 300 and/or a support leg 31 such as a generally compact position in which portions of the contact rail 16 may be folded against or in proximity to portions of a support leg 31. In this and some embodiments, a contact rail 16 may comprise a rail retainer 37 which may be configured to temporarily engage a rail retainer catch 38 on a support leg 31 thereby securing the putter rail apparatus 12 in a compact position. In other embodiments, a contact rail 16 may comprise a rail retainer catch 38 which may be configured to temporarily engage a rail retainer 37 on a support leg 31 thereby securing the putter rail apparatus 12 in a compact position.

In some embodiments, a putter rail apparatus 12 may comprise two support legs 31 with each support leg joined to a support leg extension 32. A support leg extension may provide additional stability by optionally increasing the surface area of the putter rail apparatus 12 that may contact the ground 300 and/or by joining one or more support legs 31 together in a rigid fashion. Optionally, a support leg 31 and/or a support leg extension 32 may comprise one or more securement apertures 39 which may be configured to receive a fastener which may be inserted into the ground 300. In some optional embodiments, a securement aperture 39 may receive a golf tee which may be also inserted into the ground 300 and which may function as a fastener to maintain the position of the putter rail apparatus 12 on the ground 300.

In further embodiments, a support leg 31 and/or a support leg extension 32 may comprise one or more cleats 41 which may be configured to contact the ground 300 and increase the frictional resistance between the ground and the putter rail apparatus 12. Optionally, one or more cleats may be removably coupled to a support leg 31 and/or a support leg extension 32 such as with a threaded fastener or any other suitable connection method.

The putter stroke training device 100 may be made from rigid and substantially rigid materials such as hard plastics, metal alloys, carbon fiber, fiber glass, wood, ceramics, or any other suitable substantially rigid material including combinations of materials. Additionally, low friction coatings and paints may be applied to the putter guide 13, putter guide extensions 14, and/or other locations of the putter stroke training device 100. Also, one or more elements may be made from or comprise durable and slightly flexible materials such as soft plastics, silicone, soft rubbers, fabrics, or any other suitable materials including combinations of materials.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A putter stroke training device, the device comprising:

a. a putter guide apparatus comprising;

i. a shaft clamp configured to removably secure a golf putter shaft, ii. an arm extension comprising a first end and a second end, wherein the shaft clamp is coupled to the first end of the arm extension and the arm extension is configured to extend away from the putter shaft, and wherein a rail contact member is coupled to the second end of the arm extension, and iii. wherein the rail contact member is configured to temporarily couple with a removable putter guide extension at a first distal end of the rail contact member so that both the rail contact member and the removable putter guide extension are both configured to make contact with a contact rail of area available for contacting the contact rail of the putter nail apparatus; and b. a putter rail apparatus having a contact rail with a contact surface configured to make contact with the rail contact member and the putter guide extension of the putter guide apparatus.

2. The putter stroke training the device of claim 1, wherein the contact surface of the contact rail is substantially planar.

3. The putter stroke training the device of claim 1, wherein;

a. the contact surface of the putter rail apparatus is substantially planar and has a first length (L1) and a first width (W1);

b. the rail contact member of the putter guide apparatus has a second length (L2) and a second width (W2); and a wherein the first length (L1) is greater than the second length (L2) and the first width (W1) is at least 150% greater than the second width (W2).

4. The putter stroke training device of claim 1, wherein the putter guide apparatus further comprises a second removable putter guide extension attached a second distal end positioned horizontally opposite to said first distal end, the second removable putter guide extension configured to further increase the horizontal length and surface area available for contacting the contact rail of the putter rail apparatus.

5. The putter stroke training device of claim 1, wherein the removable putter guide extension is removably coupled to the rail contact member of the putter guide apparatus with a fastener.

6. The putter stroke training device of claim 1, wherein the rail contact member and putter guide extension of the putter guide apparatus are of a substantially cylindrical shape.

7. The putter stroke training device of claim 1, wherein the shaft clamp of the putter guide apparatus comprises a compressionable material configured to make contact with and secure the shaft of a putter above the putter hosel.

8. The putter stroke training device of claim 1, wherein the contact rail of the putter rail apparatus is adjustable to a plurality of angled positions.

9. The putter stroke training device of claim 1, wherein the putter rail apparatus comprises a contact rail flexibly coupled with a support leg.

10. The putter stroke training device of claim 9, wherein the putter rail apparatus contact rail is flexibly coupled to a support leg with a hinge.

11. The putter stroke training device of claim 1, wherein the contact rail of the putter rail apparatus is secured into one of a plurality of angled positions by a support brace member having a first end and a second end, said first end rotatably coupled to the contact rail.

12. The putter stroke training device of claim 11, wherein the support brace member second end is configured to mate with a brace notch located on a support leg.

13. A putter guide apparatus for improving the putter stroke of a golfer, the putter guide apparatus comprising;

a. a shaft clamp configured to removably secure a golf putter shaft above a hosel;

b. an arm extension coupled to the shaft clamp at a first end and extending away from the putter shaft at an angled orientation; and c. a rail contact member coupled to a second end of the arm extension wherein the rail contact member is configured to temporarily couple with a removable putter guide extension at a distal end of the rail contact member so that both the rail contact member and the removable putter guide extension are both configured to make contact with a contact rail of a putter rail apparatus thereby increasing the horizontal length and surface area available for contacting the contact rail of the putter nail apparatus.

14. The putter guide apparatus of claim 13, wherein the putter guide apparatus contact member and putter guide extension are of a substantially cylindrical shape.

15. A putter rail apparatus configured to make contact with a contact member of a putter guide apparatus, the putter rail apparatus comprising:

a. a contact rail with a contact surface configured to be adjustable to a plurality of angled positions relative to the ground;

b. a support leg configured to be placed onto the ground and to provide support for the contact rail; and wherein the contact rail is flexibly coupled to the support leg by;

i. a rail hinge connecting a lower elongate end of the contract rail to an elongate end of the support leg, and ii. a support brace member with a first end and a second end, said first end rotatably coupled to the contact rail and said second end configured to temporarily mate with a brace notch positioned within the support leg.

16. The putter rail apparatus of claim 15, wherein the support leg comprises a set of brace notches configured to receive and mate with the second end of the support brace member thereby allowing the contact rail to be positioned in a plurality of fixed angled positions relative to the ground.

17. The putter rail apparatus of claim 16, wherein the support leg further comprises a set of cleats configured to contact the ground to increase the frictional resistance between the ground and the putter rail apparatus.

18. The putter rail apparatus of claim 17, further comprising a set of securement apertures positioned within the support leg with said securement apertures configured to receive a fastener to temporary secure the putter rail apparatus to the ground.

19. The putter rail apparatus of claim 16, wherein the support leg comprises a set of securement apertures configured to receive a fastener.

20. The putter rail apparatus of claim 19, wherein the fastener is a golf tee.

* * * * *